US010514236B2

(12) United States Patent
Tobin

(10) Patent No.: US 10,514,236 B2
(45) Date of Patent: Dec. 24, 2019

(54) DETACHABLE SHIELD FOR TACTICAL EQUIPMENT BOX

(71) Applicant: Michael W. Tobin, St. Charles, MO (US)

(72) Inventor: Michael W. Tobin, St. Charles, MO (US)

( * ) Notice: Subject to any disclaimer, the term of this patent is extended or adjusted under 35 U.S.C. 154(b) by 476 days.

(21) Appl. No.: 15/288,865

(22) Filed: Oct. 7, 2016

(65) Prior Publication Data

US 2017/0052001 A1 Feb. 23, 2017

Related U.S. Application Data

(63) Continuation-in-part of application No. 14/683,941, filed on Apr. 10, 2015, now abandoned.

(60) Provisional application No. 61/978,589, filed on Apr. 11, 2014.

(51) Int. Cl.

| | |
|---|---|
| ***F41H 5/08*** | (2006.01) |
| ***B65D 55/02*** | (2006.01) |
| ***B65D 43/16*** | (2006.01) |
| ***B65D 25/28*** | (2006.01) |
| ***B65D 43/02*** | (2006.01) |
| ***F41C 33/06*** | (2006.01) |

(52) U.S. Cl.

CPC ..... *F41H 5/08* (2013.01); *B65D 25/2808* (2013.01); *B65D 43/02* (2013.01); *B65D 43/164* (2013.01); *B65D 55/02* (2013.01); *F41C 33/06* (2013.01)

(58) Field of Classification Search

CPC ..... F41H 5/06; F41H 5/08; B65D 43/02
USPC ..... 206/317
See application file for complete search history.

(56) References Cited

U.S. PATENT DOCUMENTS

| | | | | |
|---|---|---|---|---|
| D441,954 | S * | 5/2001 | Parker | D3/273 |
| 2008/0047860 | A1* | 2/2008 | Shane | F41A 17/02 206/317 |
| 2014/0000495 | A1* | 1/2014 | Spencer | E05G 1/08 109/56 |

* cited by examiner

*Primary Examiner* — Steven A. Reynolds
*Assistant Examiner* — Javier A Pagan
(74) *Attorney, Agent, or Firm* — Charles McCloskey

(57) ABSTRACT

A detachable shield for tactical equipment box has a rectangular form, an outer surface and an opposite inner surface, a long first edge and a second edge, at least two hinges upon the first edge that cooperate with second hinges mounted to a box, a second lock component that cooperates with a prime lock component mounted to a box opposite the second hinges, and a handle joined to the inner surface. The first hinges, handle, and second lock component join to the shield without fracturing it. The first hinges separate from the second hinges so that a law enforcement officer can take the shield from the box for use as protection from projectiles. In an alternate embodiment, the shield pivotally connects to a top plate upon the box with lips that overlap the front and sides in a return.

3 Claims, 4 Drawing Sheets

8

DETACHABLE SHIELD FOR TACTICAL EQUIPMENT BOX

CROSS-REFERENCE TO RELATED APPLICATION

This nonprovisional application claims priority to pending non-provisional application Ser. No. 14/683,941 with a filing date of Apr. 10, 2015 which claims priority to provisional application No. 61/978,589 with a filing date of Apr. 11, 2014 and all are owned by the same inventor.

BACKGROUND OF THE INVENTION

The detachable shield for tactical equipment box generally relates to law enforcement equipment and more specifically to a shield that locks upon a box storing weapons therein.

For centuries, merchants, banks, corporations, people of means, and others have transported high value cargo. The cargo has such value that its container must survive a failure of its transportation and corruption of persons who handle it. High value cargo travels within containers of great strength and limited access to open them.

In olden days, high value cargo, such as gold or jewels, travelled in strongboxes. Such strongboxes had a rigid construction with reinforced edges and intricate locking mechanism. Even if a strongbox fell off a transport vehicle or the vehicle caught fire, the strongbox kept its cargo safe. In modern times, high value cargo travels in armored vehicles with less corruptible handlers and guards.

High value cargo also includes firearms and other weapons. These weapons assist law enforcement officers to carry out their duties. Law enforcement officers travel in various vehicles, automotive, aircraft, and watercraft. Such officers predominantly use upgraded sedans and now SUV. In those vehicles, weapons face transportation risks much like cargo of the olden days. In those vehicles, weapons face new risks from skilled thieves and perhaps gunrunners for extra-legal groups.

Law enforcement officers deal with active shooter situations more and more often. In those situations, a person or persons have opened fire on civilians and law enforcement must respond instantly. Law enforcement officers, also called first responders, do not have the luxury of time to travel to the police armory and load up emergency gear and special equipment prior to responding: the public expects them there already. Special units, like SWAT, take time to muster and then respond. SWAT teams generally have a small percentage of people responding to an emergency. That leaves patrol officers, your typical cop, to protect the public, instantly. Patrol officers must have their specialized weapons and safety equipment immediately available to them, in their patrol cars, so to respond safely and instantly to an active shooter situation, a riot, and the like. Any and all on duty officers must have the proper equipment, with them, to respond to these active shooter, terrorist, and other calls. At the same time, police automotive vehicles become smaller as the amount of police equipment grows.

The rising number of active shooter situations and fluctuating terrorist threats call for more law enforcement officers to respond differently than in the past, the recent past no less. Law enforcement officers must respond directly to the scene, such as the Boston marathon bombing, the Sandy Hook, Conn. school shooting, and the Aurora, Colo. movie theater shooting. Law enforcement officers must have all of their active shoot equipment that they may need to deploy.

And the equipment must remain secure within a vehicle but transfer readily from one vehicle to the next as a law enforcement officer transfers. The need for preparation and swift response has expanded from just the patrol units and SWAT teams to others. Even off-duty officers must have the preparation and equipment to respond directly to a scene. Management of law enforcement, such as command staff, administrators, and detectives must also prepare and equip themselves to respond to a scene as well. As these various persons prepare and respond to a scene, security of the equipment and convenience to a law enforcement officer become critical to effective and safe deployments.

An urgent need exists to provide police and other law enforcement with a way to transport and then secure emergency tactical gear in patrol vehicles. Such gear includes rifles, shotguns, other firearms, ballistic helmets, hard armor plates and plate carriers, ammunition, personal ballistic shields, and the like.

Police officers face an additional problem currently. Over half of the new police and law enforcement vehicles have the form of SUVs and trucks rather than the traditional sedans with trunks. Because of the lack of trunks in the current SUVs and trucks a need exists to secure and conceal tactical gear and equipment and ballistic shields.

Current events involving protests, near riots, and riots have rapidly increased deployments of police and law enforcement. Those deployments have more officers transporting more gear than in the past. The tactical protective gear, equipment, and weapons carried in police and law enforcement vehicles have a selection and arrangement made by each officer. This gear largely reflects the individual preferences of each officer rather than traditional generic or standard "in every car" equipment, commonly seen as first aid kits, blankets, fire extinguishers, and the like. Transporting all of the individual equipment, such as helmets, plates, ballistic shields, plate carriers, and weapons, to and from a patrol vehicle must be secure, rapid, and easy for the officers. Merely carrying all of these tactical items, gear, and equipment with other officer gear would call for multiple trips by an officer to and from a police department headquarters and his vehicle at the start and end of each shift for each officer.

DESCRIPTION OF THE PRIOR ART

Over the years, various containers for weapons have appeared. Army units utilize racks with locking arms, cables, and chains to store weapons in arms rooms protected by JSIIDS, joint service interior intrusion detection system, or other systems. Once a weapon is removed from an arms room, a soldier has physical contact with it at all times. However, a law enforcement officer generally keeps his weapon holstered to avoid alarming the public. A law enforcement officer has additional weapons stored in his vehicle or other location ready for the "load and respond" call to reach him. Various suppliers have provided metal lockers of hardened steel with locking mechanisms and hingedly connected steel lids. The lockers have a size and a weight suitable for lifting and placement into a vehicle trunk. Preferably the lids remain connected to the box and some models have a self closing lid. If a law enforcement officer has a shield, it fits within the prior art box and occupies a portion of the box's volume.

The prior art has also provided various gun safes, gun cabinets, and upright lockers. These containers keep guns under lock and key however the containers and their doors do not lend themselves to lifting and loading into the trunk of a patrol car.

SUMMARY OF THE INVENTION

The detachable shield for tactical equipment box has a rectangular form with an outer surface and an opposite inner surface, a long first edge and a mutually parallel and spaced apart second edge, at least two hinges upon the first edge that cooperate with second hinges mounted to a box, a second lock component that cooperates with a prime lock component mounted to a box opposite the second hinges, and a handle joined to the inner surface. The first hinges, handle, and second lock component join to the shield without fracturing it as with ballistic bolts, pan headed mechanical fasteners, or adhesives. The first hinges separate from the second hinges so that a law enforcement officer can take the shield from the box for use as a protective device from projectiles. In an alternate embodiment, the second component joins to the inner surface along with a reinforcing strip along the second edge.

The shield of the invention cooperates with other components to function as a portable single container that stores critical deployment gear of a law enforcement officer, including a rifle, other weapons, ammunition, ballistic helmet, body armor, and the like. The container has a box of a size that fits into the trunks of sedans used for law enforcement and into the rear areas of SUVs. The box has handles upon its four sides so that a law enforcement officer can carry the box and transfer it between one vehicle to another. The box includes solid D-rings or other feature that provides for securement, using a cable, of the box to the vehicle. The securement meets or exceeds federal regulatory standards.

The invention's shield maximizes the equipment that can be stored within a box equipped with the shield. The shield allows off duty officers to store their prescribed equipment safely in their homes so it remains available for "load and respond" situations. The invention's shield also cooperates with a programmable lock with key override. The invention's shield removes quickly from the remainder of a box so that a law enforcement officer has complete access within the box to its contents. The shield of the invention, though functioning as a lid to the box, also operates as an NIJ certified ballistic shield.

The present invention provides secure storage and has the unique feature of the lid detaching quickly. The lid then provides a portable ballistic shield. The lid of the present invention has an aluminum outer shell, an additional ballistic lining, or backing material, and a handle, or strap, so an officer can carry the shield and later hold the lid as a personal shield. The aluminum outer surface works with the ballistic lining to provide various ballistic threat levels of protection.

The present invention conceals it ballistic shield into the lid's design and form. The present invention then both secures the ballistic shield to a box and hides the ballistic shield from view. The concealment happens from the lid's lack of identification as a ballistic shield but rather it has the appearance of an ordinary box lid when seen from the outside.

The present invention has a volume of space to hold all of the individual gear of an officer within it. Because the lid of the invention serves as a ballistic shield, the entire kit of an officer can be transported back and forth from the police department headquarters to a patrol vehicle in a single trip. The invention allows an officer to keep all of the equipment secure while locked within the box of the present invention.

There has thus been outlined, rather broadly, the more important features of the invention in order that the detailed description thereof that follows may be better understood and that the present contribution to the art may be better appreciated. The present invention also includes a plurality of handles for the shield, lighting upon the shield, windows within the shield, a length less than five feet, and cooperative securement with cable to vehicle systems. The shield of the invention in cooperation with a box provides an all in one secure storage, ease of handling and loading into a vehicle, ease of transport, and an integral ballistic shield. With the shield operating as a lid for the box, the shield saves on volume within the box for use by other equipment. The shield permits stacking of boxes upon it for storage at a police armory and more often at the home of a law enforcement officer. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a detachable shield for tactical equipment box that operates as a lid upon a weapons strongbox and as a shield for an officer.

Another object is to provide such a detachable shield for tactical equipment box that detaches abruptly from the remainder of the strongbox.

Another object is to provide such a detachable shield for tactical equipment box that has a quick disconnect and mounting system which has a specific steel bracket kit installed in a patrol vehicle that has cooperating holes and attachments in the box for an officer to quickly secure the invention to a patrol vehicle.

Another object is to provide such a detachable shield for tactical equipment box that has a lid of a rectangular shape so officers may quickly stack, hold, or position multiple ballistic lids horizontally, or vertically, thus providing a wall of ballistic protection to a phalanx of officers behind it.

Another object is to provide such a detachable shield for tactical equipment box that has a quick fastening device to assist in connecting and positioning multiple ballistic box lids to form a larger combined shield or a shield of a certain shape.

Another object is to provide such a detachable shield for tactical equipment box made and distributed at a price suitable for purchase by law enforcement officers and various departments and agencies through retail stores, catalog supply houses, government contracting and procurement, and the like.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
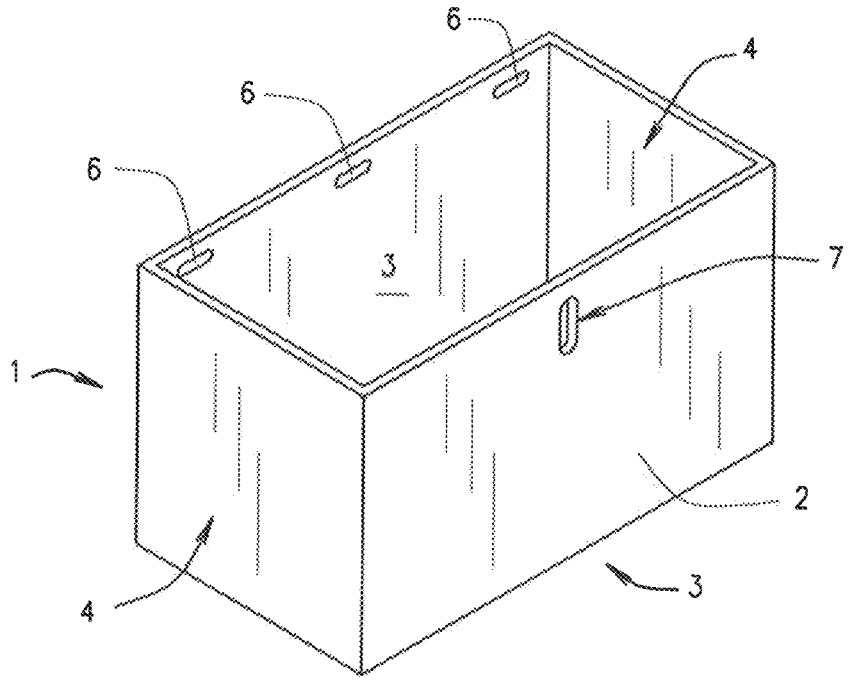
FIG. 1 provides a top perspective view of a box to receive the invention.

The present art overcomes the prior art limitations by providing a detachable shield for tactical equipment box. A tactical equipment box, or box, may take on many forms. However, as firearm weapons have a generally elongated and slender shape, boxes have a similar elongated shape, preferably rectangular prismatic. FIG. 1 has a top perspective view of a box 1 having a rectangular shape extended prismatically. The box has a rectangular front 2 and a mutually parallel, spaced apart rectangular back 3. Two mutually parallel and spaced apart sides 4 span between the front and the back. The sides 4 have a generally perpendicular orientation to the front and the back as shown. Perpendicular to and beneath the sides, the front, and the back, the box has a bottom 5 generally placed first into a vehicle's trunk during usage. The sides have a height above the bottom that defines the height of the front and the back. The front and the back have mutually similar lengths and their lengths generally exceed that of the sides.

Upon the back 3 generally spaced opposite the bottom 5, the box has at least two, and up to and including nine second hinges 6. The Applicant prefers three second hinges 6 as shown. The second hinges have a mutual spacing selected for even load distribution to the back 3 and to a shield later shown. Opposite the second hinges, the front 2 has a prime component 7 of a lock assembly. This prime component has a cylinder for keyed access and an electronic portion for combination access. The prime component has an aperture, not shown, to receive a secondary component upon the shield later shown.

Figure 2:
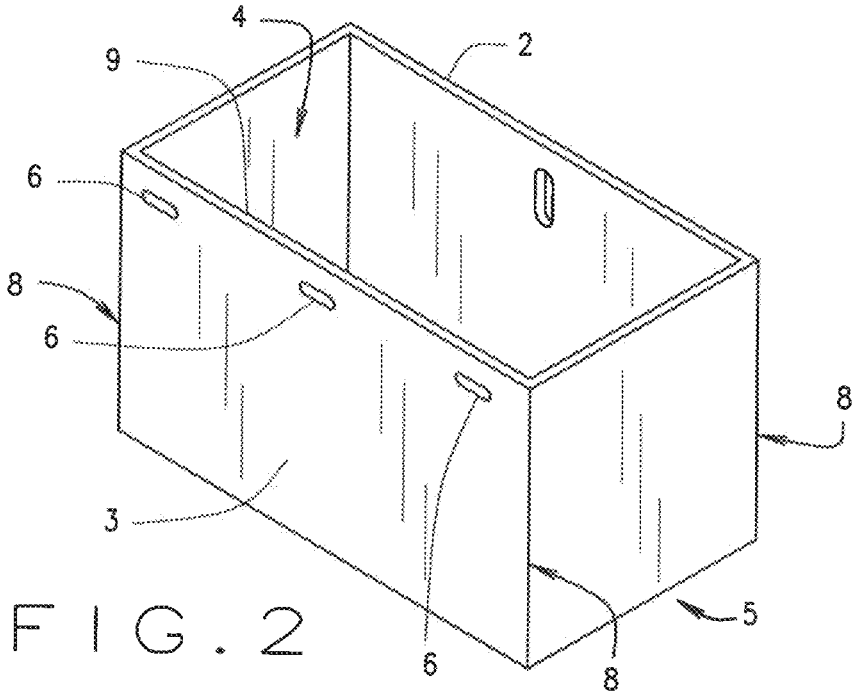
FIG. 2 shows another top perspective view of a box that receives the invention.

FIG. 2 shows another perspective view of a box 1 with the back 3 towards the foreground and a side 4 to the right in this figure. The back has the second hinges 6, here shown as three, spaced above the bottom and inwardly from corners 8 defined as lines of abutment between the sides and the back. Corners also exist where the front abuts the sides. The second hinges have a position generally within the box, that is, upon an inner surface 9 of the back. As later shown, the second hinges secure to the back and a portion of that securement appears visible upon the exterior of the back. Alternatively, the second hinges connect entirely to the interior surface of the back without penetration to the exterior surface. The second hinges, in all embodiments, have a spacing that limits flexing of the shield later shown. The limit of the spacing prevents a thief from prying into the box between the hinges and deforming the shield.

Figure 3:
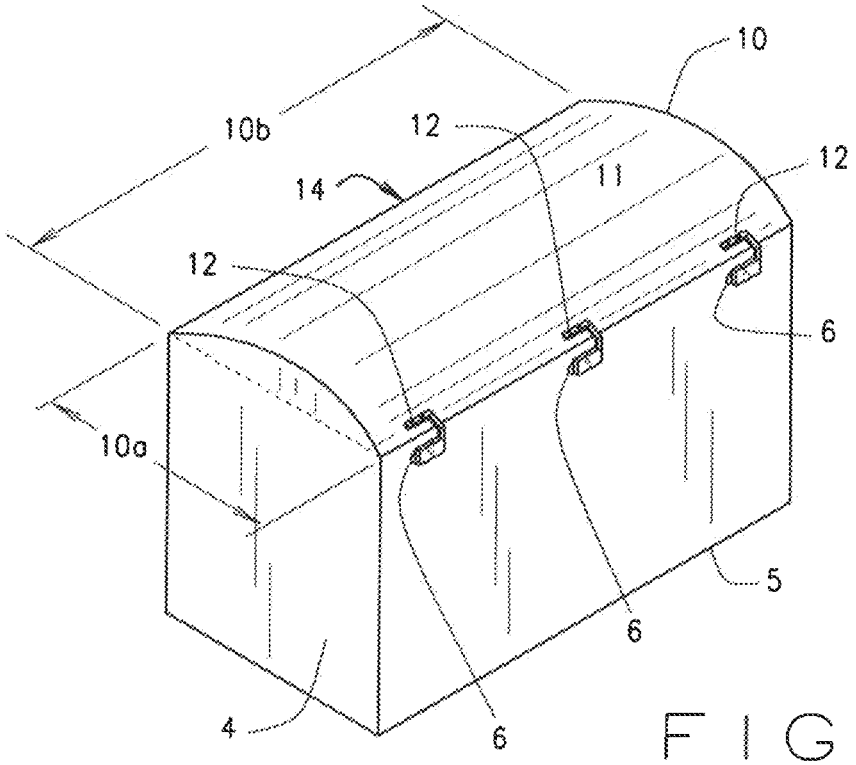
FIG. 3 describes a top perspective view of a box having the invention thereon.

Having referred to the shield previously, FIG. 3 shows a shield 10 in a top perspective view upon the box 1 generally opposite the bottom 5. The shield has a width 10*a* at least that of the length of a side 4 and a length 10*b* similar to that of the front and the back. The shield rests upon the sides, the front, and the back above the bottom with a smooth and flush joint. Once more, the joint of the shield to contiguous edges limits the opportunity for a thief to pry beneath the shield and gain entry to the box. The shield has a generally rectangular form with an outer surface 11 showing in this figure. The shield may have an arcuate cross section as shown or alternatively a flat cross section. The shield has a first edge 13 oriented generally parallel to the back 3 and a mutually parallel and spaced apart second edge 14 oriented generally parallel to the front 2.

Upon the first edge, the shield has a plurality of first hinges 12 of the same number as the second hinges previously shown. The first hinges cooperate with the second hinges so that the shield pivots upwardly from the box towards the back so that a law enforcement officer may access the contents within the box. Because the first hinges join to the shield, the shield may separate from the box as desired by the law enforcement officer.

Figure 4:
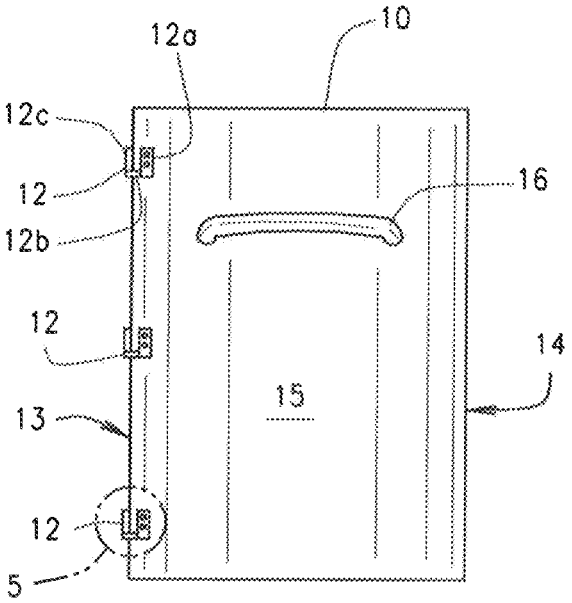
FIG. 4 illustrates a bottom view of a shield of the invention.

When a law enforcement officer removes the shield 10 from the box 1, the shield appears in a bottom view in FIG. 4. The shield has its rectangular form but with its inner surface 15 showing in this figure. Upon the inner surface and spaced between the second edge 14 and the first edge 13, the shield has an elongated handle 16 spaced away from the center of the shield as shown. Upon the first edge, the shield has the plurality of first hinges 12. Each first hinge has a generally reversed J like shape having a long stem 12*a*, a base 12*b*, and a mutually parallel and spaced apart short stub 12*c* outwardly from the stem. The long stem attaches the first hinge to the shield using ballistic bolts, an adhesive, rivet, and the like. For stability, the long stem has two connections, as at 12*d*, to the shield's inner surface. The base spaces the short stub away from the stem so that the stub engages a cooperating member in a second hinge. The cooperating member may include a slot that accepts the stub slid into it. Typically the first hinges all have the same orientation with their stubs aligned in the same direction as shown. This alignment allows a law enforcement officer to insert the stubs readily and to remove them faster when deploying the shield away from the box. Here, the stubs extend slightly beyond the first edge to allow for engagement with the second hinges. In an alternate embodiment, the stubs remain within the first edge.

The shield also has a second component 17 of the lock generally opposite the first hinges, that is, upon the second edge 14. The second component joins to the shield as do the first hinges as in ballistic bolts, an adhesive, rivet, and the like. The second component extends outwardly from the plane of the shield, that is, towards the reader so it may engage the prime component of the lock. The second component has a hook like, hasp like, or other shape suitable for clasping with the prime component of the lock. This figure shows one second component because having a single lock speeds a law enforcement officer when unlocking the shield from the box.

However, as described above, the shield seeks to limit the opportunity for a thief to pry between it and the box. A single second component may present an unbraced length of the second edge 14 so that a thief may pry it. In an alternate embodiment, the shield includes a reinforcing bar merged into it along the second edge 14.

Figure 5:
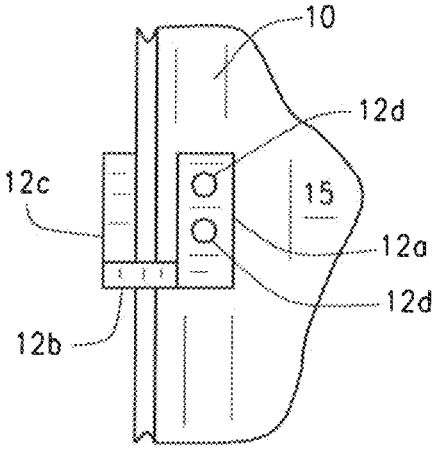
FIG. 5 provides a detail view of a connection of the invention.

And turning to FIG. 5, each first hinge 12 connects to the shield in a manner that maintains the integrity of it and avoids shattering it. The shield remains intact when used and abused as a lid and when later deployed in its purpose to protect an officer from projectiles. Each first hinge has its shape as previously described with a long stem 12*a*. The long stem has positions for physical connection to the shield. The connection, as at 12*d*, may take the form of ballistic bolts, here shown in a paired arrangement, as adhesive bonding to the shield in two positions or along the length of the long stem, or like connection. The second component of the lock connects similarly.

Figure 6:
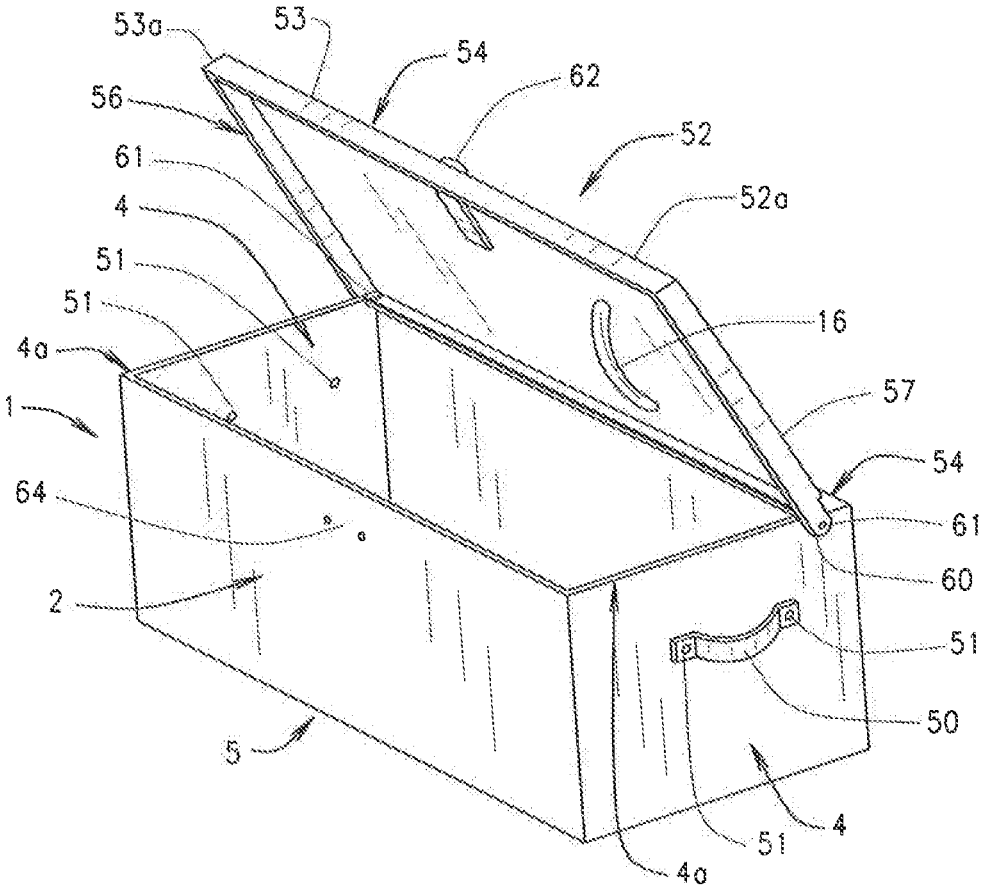
FIG. 6 provides a top perspective view of an alternate embodiment of the invention.

FIG. 6 shows an alternate embodiment of the present invention in a top perspective view with the box 1 having a rectangular shape extended prismatically. The box has a rectangular front 2 that faces an officer during opening, that is, towards the rear of a patrol vehicle, and a mutually parallel, spaced apart rectangular back 3. Two mutually parallel and spaced apart sides 4 span between the front and the back. The sides 4 have a generally perpendicular orientation to the front and the back as shown and follow the length of a patrol vehicle. Each side has a box handle 50 secured at two points, as at 51, such as by riveting, welding, bolting, and the like, for an officer to grasp. Perpendicular to and beneath the sides, the front, and the back, the box has a bottom 5 generally placed first into a vehicle's trunk during usage. The sides have a height above the bottom that defines the height of the front and the back. The front and the back have mutually similar lengths and their lengths generally exceed that of the sides.

Opposite the bottom 5, the front 2, the back 3, and the two sides 4 define a rectangular opening of a set width and length. The opening has a size of approximately sixteen inches by thirty six inches where the sides have approximately sixteen inches in width and the front and the back have approximately thirty six inches in length. The box closes the opening with a snug fitting lid 52 of a rectangular shape proportional to that of the opening and thus the box.

Existing shields do not fit into or within existing boxes and thus an officer stores an existing shield separate from a box. An existing shield remains visible as separate from the other contents within the rear of a patrol vehicle. The lid, along with closing the box, serves as a ballistic shield. This lid, or shield, generally has a flat, somewhat planar form with a perimeter 52*a* and a lip 53 upon the perimeter. The lip 53 extends generally perpendicular to the remainder of the shield. The lip overlaps the upper edges of a box's front 2, and sides 4, as a return 53*a*, approximately one inch in depth. The box also has a thin top plate 59 generally parallel and spaced apart to the bottom 5 and extending inwardly from the back. The top plate has a width less than three inches and a length similar to that of the width of the back, nearly thirty six inches. The top plate joins to the two sides using welding, adhesive, machining, mechanical connection and the like. The top plate permits a portion of the lip to rotate against it and then close the opening as later shown in FIG. 7. The lip improves security by increasing the difficulty in grabbing a fulcrum with a pry bar or other tool. The lip extends slightly outwardly of the box as shown by the return.

Opposite the bottom 5, each side 4 has an edge 4*a* at the opening. The edge extends from the front 2 rearwardly to a notch 60 proximate the back and opposite the front. The notch has a partially triangular shape with a narrow depth towards the front and a wider depth towards the back. The notch has its maximum depth below the top plate 59. The notch on each side receives a pin 61 from the lid that functions as a hinge so that an officer may open and close the lid 52 over the opening upon the box 1.

The lid has two mutually parallel and spaced apart longitudinal edges that parallel the front 2 and the back 3 of the box 1. Perpendicular to the longitudinal edges, the lid has two mutually parallel and spaced apart lateral edges that parallel the sides of the box. The longitudinal edges have a first lip 54 adjacent to the front 2 and an opposite second lip 55 spaced away from the first lip for placement adjacent to the top plate 59 and still proximate back, and a third lip 56 adjacent to the side 4 on the left of the box and an opposite fourth lip 57 adjacent to the side 4 on the right of the box as later shown. The first lip, the second lip, the third lip, and the fourth lip extend downwardly, that is, towards the bottom 5 of the box for about one inch.

More particularly, the second lip 55 hangs beneath the lid but does not join to the third lip and the fourth lip. The second lip has a narrow notch spacing it from the third lip and the fourth lip so that the lid may close upon the box and the edges 4*a* of the sides 4 may rest between the third lip, the fourth lip, and the second lip. The third lip and the fourth lip each have a pin 61 that extends perpendicular to the third lip and the fourth lip and mutually inwardly. The pins are generally spaced beneath the below the remainder of the lid. Though a pin in notch as a hinge has been described, the Applicant foresees other separable pivoting connections for use between the lid and the sides of the invention.

While concealing its cargo and purpose from an erstwhile thief, the box of the invention also has its lid 52 ready for use by an officer as a ballistic shield. Such a shield has a handle 16 here shown beneath the lid, that is, within the four lips 53. The handle attaches to the lid at two points 51 using rivets, carriage bolts, other mechanical means, adhesives, and the like.

The lid 52 also has a first component 62 of a lock. The first component attaches to the lid opposite the lip 53 and more particularly opposite the second lip 55 that is towards the front 2. The first component has an upward rim 63 as later shown in FIG. 7. The first component engages a second component 64 of a lock, not shown. The first component may include a cylinder for keyed access and an electronic portion for combination access. The first component resists ballistic action as it is exposed on the front of the lid 52 when used as a shield.

Figure 7:
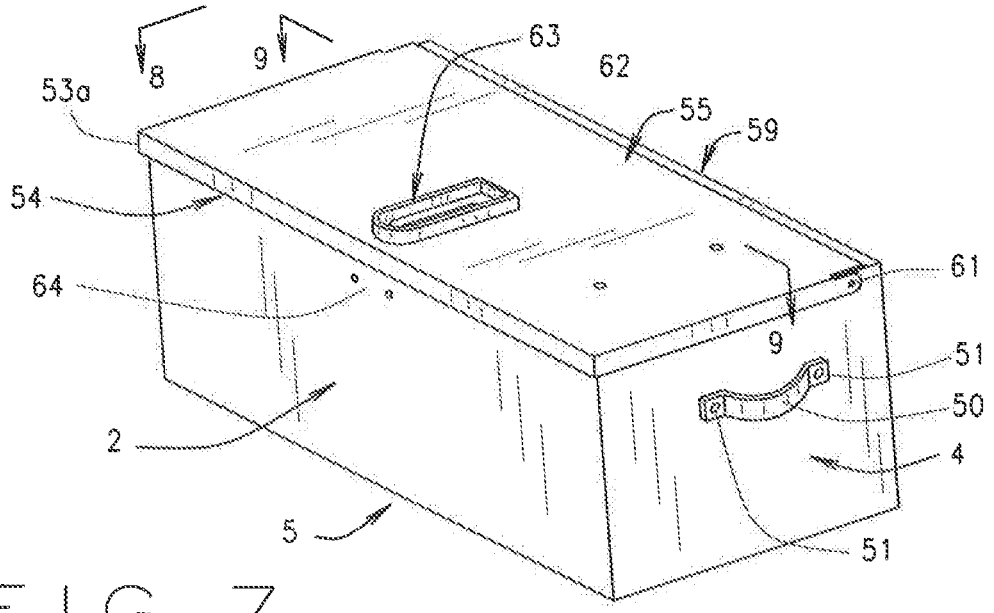
FIG. 7 shows another top perspective view of an alternate embodiment of the invention.

Turning the box 1 of this alternate embodiment, FIG. 7 shows a perspective view with the lid 52 closed upon the box 1. The lid 52 pivots upon the second lip 55 and rotates towards the box, that is, the front 2 and the two sides 4. The lid then becomes coplanar with the top plate 59 as its pivots upon the pins 61 engaged in the notches 60. The first lip 54 overlaps the edge of the front 2, the fourth lip 57 overlaps the edge 4*a* of the right side 4 shown in the foreground of this figure, and the third lip overlaps the edge of the left side not shown in this figure. The fourth lip 59 shows an exterior end as at 61*a* of its pin 61 which reminds the officer of the hinge type pivoting connection of the lid to the box. The left side and the right side are generally symmetric and thus another perspective view is not provided.

The first lip, the third lip, and the fourth lip each have a return and a snug overlap as at 53*a* with the front, the right side, and the left side respectively. The overlap is approximately one inch to deter prying. The second lip 55 has a flush arrangement adjacent to the top plate 59. This flush arrangement also deters prying by a thief or other unauthorized person.

With the lid closed upon the box, the first component 62 of the lock engages the second component 64, not shown. The first component has a generally centered position relative to the front and a position close to the front 2 for ease of officer use. The rim 63 of the first component extends upwardly from the lid as shown, that is, opposite the other lips, collectively lip 53. Proximate the right side in this figure, the lid 52 has two points 51 showing the attachment of the handle 16 concealed within the box 1.

Figure 8:
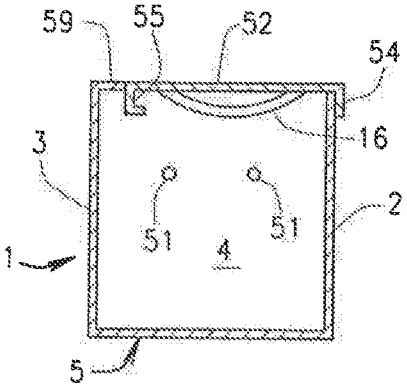
FIG. 8 shows a sectional view through the invention.

FIG. 8 shows a section through the box 1 with the side 4, from the right of FIG. 7, in the background thus the reader views the box with the side from the left removed. The box 1 has its bottom 5 with the mutually parallel and spaced apart front 2 and back 3. The front and the back have a top edge upon which rests the lid 52. The lid shows its generally planar form with the lip 53 upon the perimeter. In this view, the lid has in particular the first lip 54 shown to the right and opposite the first lip, the second lip 55. The second lip is generally parallel to the first lip. The second lip though has a cross section of an angular shape, or L shape. This cross section provides rigidity to the second lip because its ends do not join to the third lip and the fourth lip. The second lip has its ends free and spaced enough from the third lip and the fourth lip to admit the thickness of a side 4. Outwardly from the second lip, the box 1 has the top plate 59. The top plate spans from the side 4 upon the left to the side 4 upon the right, here shown in the background. The top plate joins to the top edge of the back at a flush right angle. Unlike the first lip, the third lip, and the fourth lip, the top plate does not have a return. The lid 52 has the shield handle 16 hanging within the first lip and the second lip, that is, within the box. Below the handle as shown, the side 4 has two points 51 that secure the box handle, not shown.

Figure 9:
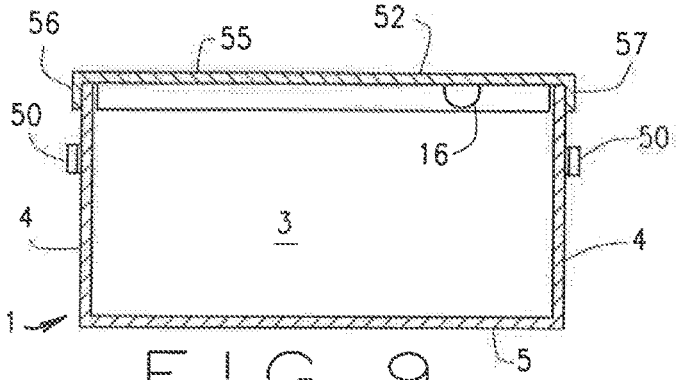
FIG. 9 shows another section view through the invention generally perpendicular to FIG. 8.

Looking into the box 1 from the front 2, FIG. 9 shows the lid 52 closed upon the box 1 above the bottom 5 and resting upon the sides 4 upon the left and the right as shown. This figure has the front lip not shown. Each side has its box handle 50 upon its exterior so that an officer may grasp it. The lid has its third lip 56 shown to the left. The third lip extends downwardly from the plane of the lid and below the top edge of the side 4 for about an inch. This return feature deters prying and other modes of improper access into the box. Opposite the third lip, the lid has its fourth lip, generally a mirror image of the third lip. Between the third lip and the fourth lip, the lid has its second lip 55 also hanging downwardly similar to the third lip and the fourth lip. As described above, the second lip has an L shape though shown here on edge with the L extending out of the plane of the figure. The second lip has its length slightly less than the width of the back 3. The second lip has two spaced apart ends and a pin 61 upon each end. Each pin engages a cooperating notch as previously described for opening and closing of the lid. Towards the right, the lid has the shield handle 16 hanging downwardly towards the bottom. The second lip, the third lip, and the fourth lip, form a common plane above the bottom 5.

Figure 10:
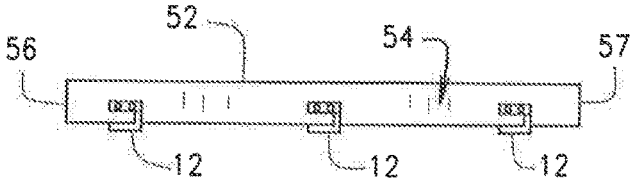
FIG. 10 provides a back view of the lid of the invention.

A further alternate embodiment of the lid appears in FIG. 10. The lid of this alternate embodiment has its rectangular shape that allows officers to quickly stack, hold, or position multiple ballistic lids horizontally, that is, left to right, or vertically, that is bottom to top, thus providing a wall of ballistic protection to a phalanx of officers behind it. FIG. 10 shows a front view of the lid with the first lip 54 in the foreground. The first lip has at least two and preferably three male components 12. The male component has a tab for attachment to the first lip and then a cylinder with a free end. The cylinder attaches to the tab upon one end only thus leaving a somewhat reverse C shape in this view.

Figure 11:
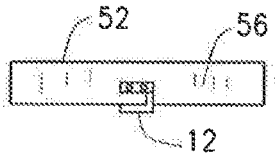
FIG. 11 provides a front view of the lid of the invention opposite FIG. 10.

FIG. 11 then shows a side view of the lid 52 with the third lip 56 in the foreground. This lip has at least one of the male components 12 installed upon it. This male component has a generally centered location upon the third lip and orients the cylinder to the left in this figure.

Opposite FIG. 10, FIG. 11 shows the second lip 55 in this alternate embodiment with a back view of the lid. The second lip, in the foreground, has at least two and preferably three female components 58. The female component has a tab for attachment to the second lip and then a hollow cylinder 12*e*, or tube, with a free end. The hollow cylinder attaches to the tab upon one end only thus leaving a somewhat C shape in this view. The hollow cylinder has an internal diameter and shape that received the cylinder of a male component 12. Though the female component is described as receiving the male component, the Applicant foresees other forms a separable hinge connection. The female components and the male components upon the second lip may also cooperate and form a hinge in the absence of the top plate.

Figure 13:
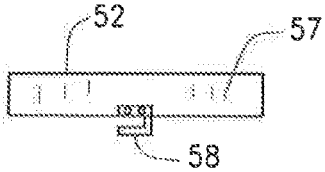
FIG. 13 describes an opposite side view of the lid of the invention.

And, opposite FIG. 11, FIG. 13 then shows another side view of the lid 52 with the fourth lip 57 in the foreground. This lip has at least one of the female components 58 installed upon it. This female component has a generally centered location upon the fourth lip and orients the cylinder to the right in this figure.

Figure 12:
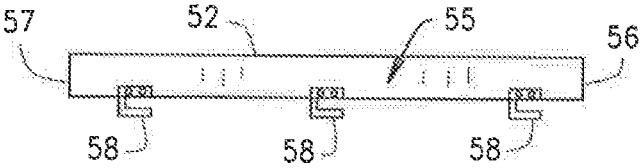
FIG. 12 describes a side view of the lid of the invention.

To what purpose do the four lips have male components and female components? Officers using multiple lids, such as in riot control deployment, may take two adjacent lids and interlock them using the male components 12 of a first lip of one shield to the female components 58 of a second lip of a second shield in assembling a horizontal shield wall. Each lid has a male component 12 on the third lip 56 of the left side 4 shown in FIG. 12 and a female component 58 on the fourth lip 57 of the right side 4 shown in FIG. 13. The officers may take adjacent lids and interlock them using the male components 12 of a third lip of one shield to the female components 58 of a fourth lip of a second shield in assembling a vertical shield wall.

Figure 14:
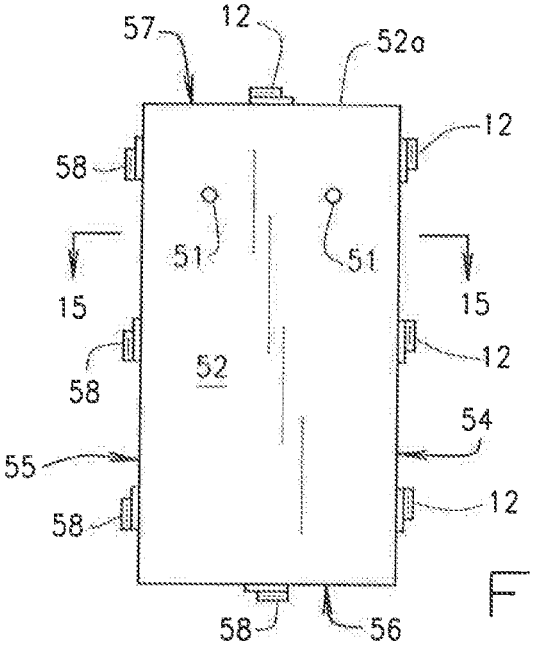
FIG. 14 show a top view of the lid of the invention.

FIG. 14 shows a top view of the lid 52 with its generally rectangular shape and first lip 54, second lip 55, third lip 56, and fourth lip 57 extending into the plane of the figure and not shown. The lid has its rectangular perimeter 52*a* here defining the width and length of the lid. Upon the first lip 54, the lid has three male components though alternate numbers are foreseen. The male components have an orientation in the same direction, here shown downwardly. Upon the second lip 55, the lid has three female components though alternate numbers are foreseen. The female components also mutually orient in the same direction, here shown upwardly, that is opposite the male components on the first lip. This orientation of components allows one shield, or lid, to be slide axially to an adjacent lid to form a wall of shields. This type of connection also resists attack from those persons opposite the wall of shields. Upon the third lip 56, the lid has one female component though a greater number is possible according to the Applicant. For this figure, the female component 58 has a generally centered position upon the third lip. And opposite the third lip 56, the lid has the fourth lip 57 with one male component 12 though the Applicant foresees a possible greater number. For this figure, the male component 12 has a generally centered position upon the fourth lip. The male component 12 upon the fourth lip and the female component 58 upon the third lip orient in opposite directions to ease assembly of adjacent shields into a vertical wall. As before, the lid 52 shows two contact points 51 from which the shield handle, not shown, connects. The previously described male components and female components operate as a quick fastening device to assist officers in connecting and positioning multiple ballistic box lids to form a larger combined shield or a shield of a certain shape.

Figure 15:
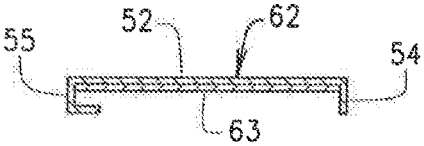
FIG. 15 provides a sectional view through the lid.

And, FIG. 15 shows a sectional view through the lid 52. The lid has an outer layer 62, generally of a ballistic proof material suitable for forming into a rectangular shape with depending lips, as at the first lip 54, and the second lip 55. With the lip 53, including the first lip 54, the second lip 55, the third lip 56, and the fourth lip 57, the lid has an inner layer 63. The Applicant suggests aluminum and Plexiglas® for the outer layer and backing material and additional Plexiglas® for the inner layer however, other ballistic proof materials will also complement this invention and its various parts and components.

A container for weapons and police equipment has a box with a front, a mutually parallel and spaced apart back, two sides mutually parallel and spaced apart sides, a bottom, a top plate opposite the bottom and proximate the back, the sides being perpendicular to the front. The box then has a lid of ballistic material pivoting upon the top plate, the lid having a closed position upon the front and the sides wherein the lid is coplanar with the top plate, an open position spaced above the front and the sides wherein the lid attains an angle to the bottom, and a detached position wherein the lid separates from the box for independent usage by a user. The lid has a perimeter and a lip hanging beneath the perimeter and the lid cooperates with the box to present an ordinary appearance to avoid alerting another to its contents all while the lid serves as a bulletproof shield for a user.

The lip has components of a first lip, a spaced apart second lip, a third lip and a mutually parallel and spaced apart fourth lip, the third lip and the fourth lip being perpendicular to the first lip. With the lip in the closed position, the first lip overlaps a portion of the front, the third lip overlaps a portion of one of the sides, and the fourth lip overlaps a portion of the other of the sides, wherein each of the first lip, the third lip, and the fourth lip have a return over the box. Also with the lip in the closed position, the first lip overlaps a portion of the front, the third lip overlaps a portion of one of the sides, and the fourth lip overlaps a portion of the other of the sides, and each of the first lip, the third lip, and the fourth lip have a return over the box along with the second lip being adjacent to the top plate. In the open position of the lid, or bulletproof shield, the first lip is spaced outwardly from the front, the third lip is spaced outwardly from one of the sides, and the fourth lip is spaced outwardly from the other of the sides, while the second lip is adjacent to the top plate and the lid rotates outwardly from the box upon the second lip. The second lip has a generally L shaped cross section.

Each of the sides has a notch opposite the bottom and the front. The second lip has two pins, generally coaxial, mutually spaced apart, and oriented outwardly wherein each of the pins rests upon one of the notches. The lid, or bulletproof shield, pivots upon the pins from the closed position to the open position. The lid separates from the box as an officer pulls the lid lifting the pins from the notches.

The lid has a first component and the front has a second component so that the first component and the second component cooperate to secure the lid upon the box when in the closed position. The lid also has a shield handle upon it generally oriented downwardly with the lip and not visible out of the box when the lid is in the closed position. Each of the sides has a box handle thereon generally oriented in a direction outwardly of the lip. The lid also has an outer layer including the first lip, the second lip, the third lip, and the fourth lip and an inner layer locating opposite the outer layer wherein the outer layer has ballistic protection and the inner layer provides backing.

To assist with combining two or more shields, the lid or ballistic shield has at least two male components upon the first lip, at least two female components upon the second lip, at least one male component upon the third lip, at least one female component upon the fourth lip. The components connect adjacent shields when one of the male components on a first lid cooperatively connects with one of the female components on a second lid thus allowing multiple lids to form a horizontal shield and multiple lids to form a vertical wall. Each of the male components readily connects with each of the female components for rapidly assembly of a horizontal shield and a vertical wall and also readily separates from each of the female components for abrupt disassembly of a horizontal shield and of a vertical wall.

This invention has a further alternate embodiment with a quick disconnect and mounting system. This system has a specific steel bracket kit installed in a patrol vehicle and cooperating holes and attachments in the box of the present invention for an officer to quickly secure the invention to a patrol vehicle.

From the aforementioned description, a detachable shield for tactical equipment box has been described. The detachable shield for tactical equipment box is uniquely capable of securing to a box sufficiently to meet federal weapons storage regulations and removing readily from the box for use as a shield against projectiles. Further, the detachable shield for tactical equipment box may also have additional hinge points and a reinforced second edge. The detachable shield for tactical equipment box and its various components may be manufactured from many materials, including but not limited to, polymers, such as nylon, polypropylene, polyvinyl chloride, high density polyethylene, polypropylene, ferrous and non-ferrous metal foils, their alloys, ceramics, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A container for weapons and police equipment comprising:

a box having a front, a mutually parallel and spaced apart back, two mutually parallel and spaced apart sides, a bottom, a top plate opposite said bottom and proximate said back, said sides being perpendicular to said front;

a lid of ballistic material pivoting upon said top plate, said lid having a closed position upon said front and said sides wherein said lid is coplanar with said top plate, an open position spaced above said front and said sides wherein said lid attains an angle to said bottom, and a detached position wherein said lid separates from said box for independent usage by a user;

said lid having a perimeter and a perimeter lip hanging beneath said perimeter;

wherein said lid cooperates with said box to present an ordinary appearance to avoid alerting another to its contents;

wherein said lid serves as a bulletproof shield for a user;

said perimeter lip having a first lip, a spaced apart second lip, a third lip and a mutually parallel and spaced apart fourth lip, said third lip and said fourth lip being perpendicular to said first lip;

said lid being in one of said closed position and said open position;

wherein said perimeter lip being in said closed position said first lip overlapping a portion of said front, said third lip overlapping a portion of one of said sides, and said fourth lip overlapping a portion of the other of said sides, wherein each of said first lip, said third lip, and said fourth lip have a return over said box, said second lip being adjacent to said top plate;

wherein said perimeter lip being in said open position said first lip being spaced outwardly from said front, said third lip being spaced outwardly from one of said sides, and said fourth lip being spaced outwardly from the other of said sides, wherein said second lip being adjacent to said top plate and said lid being rotated outwardly from said box upon said second lip;

each of said sides having a notch opposite said bottom and said front;

said second lip having two pins, generally coaxial, mutually spaced apart, and oriented outwardly wherein each of said pins rests upon one of said notches;

wherein said lid pivots upon said pins from said closed position to said open position; and, wherein said lid separates from said box as a user pulls said lid lifting said pins from said notches.

2. A concealed weapons and police equipment container comprising:

a bulletproof shield having a perimeter and a perimeter lip hanging beneath said perimeter;

a box having a front, a mutually parallel and spaced apart back, two mutually parallel and spaced apart sides, a bottom, a top plate opposite said bottom and proximate said back, said sides being perpendicular to said front;

said bulletproof shield having a closed position upon said front and said sides said bulletproof shield being coplanar with said top plate, an open position spaced above said front and said sides said bulletproof shield attaining an angle to said bottom, and a detached position wherein said bulletproof shield separates from said box for independent usage by a user;

wherein said bulletproof shield cooperates with said box to present an ordinary appearance to avoid alerting another to its contents;

said perimeter lip having a first lip, a spaced apart second lip, a third lip and a mutually parallel and spaced apart fourth lip, said third lip and said fourth lip being perpendicular to said first lip;

said bulletproof shield being in one of said closed position and said open position;

wherein said perimeter lip being in said closed position said first lip overlapping a portion of said front, said third lip overlapping a portion of one of said sides, and said fourth lip overlapping a portion of the other of said sides, wherein each of said first lip, said third lip, and said fourth lip have a return over said box, said second lip being adjacent to said top plate;

wherein said perimeter lip being in said open position said first lip being spaced outwardly from said front, said third lip being spaced outwardly from one of said sides, and said fourth lip being spaced outwardly from the other of said sides, wherein said second lip being adjacent to said top plate and said lid being rotated outwardly from said box upon said second lip;

said bulletproof shield pivoting adjacent to said top plate and adjacent to each of said sides upon a separable hinge;

each of said sides having a notch opposite said bottom and said front;

said second lip having two pins, generally coaxial, mutually spaced apart, and oriented outwardly wherein each of said pins rests upon one of said notches;

wherein said bulletproof shield pivots upon said pins from said closed position to said open position; and, wherein said bulletproof shield separates from said box as a user pulls said lid lifting said pins from said notches.

3. A container for weapons and police equipment comprising:

a box having a front, a mutually parallel and spaced apart back, two mutually parallel and spaced apart sides, a bottom, a top plate opposite said bottom and proximate said back, said sides being perpendicular to said front;

a lid of ballistic material pivoting upon said top plate, said lid having a closed position upon said front and said sides wherein said lid is coplanar with said top plate, an open position spaced above said front and said sides wherein said lid attains an angle to said bottom, and a detached position wherein said lid separates from said box for independent usage by a user;

said lid having a perimeter and a perimeter lip hanging beneath said perimeter;

wherein said lid cooperates with said box to present an ordinary appearance to avoid alerting another to its contents;

wherein said lid serves as a bulletproof shield for a user;

said perimeter lip having a first lip, a spaced apart second lip, a third lip and a mutually parallel and spaced apart fourth lip, said third lip and said fourth lip being perpendicular to said first lip, said second lip having a generally L shaped cross section;

said lid being in one of said closed position and said open position;

wherein said perimeter lip being in said closed position said first lip overlapping a portion of said front, said third lip overlapping a portion of one of said sides, and said fourth lip overlapping a portion of the other of said sides, wherein each of said first lip, said third lip, and said fourth lip have a return over said box, said second lip being adjacent to said top plate;

wherein said perimeter lip being in said open position said first lip being spaced outwardly from said front, said third lip being spaced outwardly from one of said sides, and said fourth lip being spaced outwardly from the other of said sides, wherein said second lip being adjacent to said top plate and said lid being rotated outwardly from said box upon said second lip;

each of said sides having a notch opposite said bottom and said front;

said second lip having two pins, generally coaxial, mutually spaced apart, and oriented outwardly wherein each of said pins rests upon one of said notches;

wherein said lid pivots upon said pins from said closed position to said open position;

wherein said lid separates from said box as a user pulls said lid lifting said pins from said notches;

said lid having a first component securable to said front when in said closed position;

said lid having a shield handle thereon generally oriented downwardly with said lip, each of said sides having a box handle thereon generally oriented in a direction outwardly of said perimeter lip; and, said lid having an outer layer including said first lip, said second lip, said third lip, and said fourth lip and an inner layer locating opposite said outer layer wherein said outer layer has ballistic protection and said inner layer provides backing.

* * * * *